US011703796B2

(12) United States Patent
Nishioka

(10) Patent No.: US 11,703,796 B2
(45) Date of Patent: Jul. 18, 2023

(54) IMAGE FORMING APPARATUS

(71) Applicant: KYOCERA Document Solutions Inc., Osaka (JP)

(72) Inventor: Nobuhiro Nishioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/898,105

(22) Filed: Aug. 29, 2022

(65) Prior Publication Data

US 2023/0063902 A1 Mar. 2, 2023

(30) Foreign Application Priority Data

Aug. 30, 2021 (JP) ..... 2021-140152

(51) Int. Cl.
*G03G 21/16* (2006.01)
*G03G 15/00* (2006.01)

(52) U.S. Cl.
CPC ..... *G03G 21/1652* (2013.01); *G03G 15/6511* (2013.01); *G03G 15/80* (2013.01); *G03G 21/1633* (2013.01)

(58) Field of Classification Search
CPC ..... G03G 15/165; G03G 15/1665; G03G 15/6511; G03G 15/657; G03G 15/80; G03G 21/1633; G03G 21/1652; G03G 2215/00544; G03G 2221/166
See application file for complete search history.

(56) References Cited

U.S. PATENT DOCUMENTS

| | | | | |
|---|---|---|---|---|
| 7,509,083 | B2 | 3/2009 | Inui et al. | |
| 2007/0253755 | A1 | 11/2007 | Inui et al. | |
| 2011/0103850 | A1* | 5/2011 | Watanabe | G03G 15/657 399/315 |
| 2019/0004455 | A1* | 1/2019 | Takase | G03G 15/165 |

FOREIGN PATENT DOCUMENTS

JP 2007-298735 A 11/2007

* cited by examiner

*Primary Examiner* — Sophia S Chen
(74) *Attorney, Agent, or Firm* — Studebaker & Brackett PC

(57) ABSTRACT

In an image forming apparatus according to the present disclosure, when a conveyance unit is closed, a second end is disconnected from a ground contact, and a third end makes an electrical connection with a contact spring. When the conveyance unit is opened, the second end makes an electrical connection with the ground contact, and the third end is disconnected from the contact spring.

4 Claims, 9 Drawing Sheets

IMAGE FORMING APPARATUS

INCORPORATION BY REFERENCE

The present application claims priority under 35 U.S.C. § 119 to Japanese Patent Application No. 2021-140152, filed on Aug. 30, 2021. The contents of this application are incorporated herein by reference in their entirety.

BACKGROUND

The present disclosure relates to an image forming apparatus.

There is a ground plate in general, which is electrically connected to a support member that supports a guide plate.

SUMMARY

An image forming apparatus according to the present disclosure includes a main body, a conveyance unit, and a feed unit. The conveyance unit conveys a sheet. The conveyance unit is supported by the main body with the conveyance unit allowed to move freely as the conveyance unit is opened and closed. The feed unit is placed to face the conveyance unit. The feed unit forming a conveyance path with the conveyance unit to convey the sheet when the conveyance unit is closed. The main body includes a chassis and a ground contact. The chassis is grounded. The ground contact is provided for the chassis. The conveyance unit includes a guide plate and a first wiring. The guide plate guides the sheet in a conveyance direction. The first wiring is connected to the guide plate and extends from the guide plate to the ground contact. The first wiring includes a first end, a second end, a third end, a first main line, a first branch line, and a second branch line. The first end is connected to the guide plate. The second end is allowed to move freely as the second end is connected to and disconnected from the ground contact. The third end is exposed toward the feed unit. The first main line extends from the first end. The first branch line branches off from the first main line and extends to the second end. The second branch line branches off from the first main line and extends to the third end. The feed unit includes a second wiring. The second wiring includes a contact spring, a resistance element, a ground spring, and a second main line. The contact spring is allowed to move freely as the contact spring is connected to and disconnected from the third end. The ground spring is grounded to the chassis. The second main line connects the contact spring, the resistance element, and the ground spring. When the conveyance unit is closed, the second end is disconnected from the ground contact, and the third end makes an electrical connection with the contact spring. When the conveyance unit is opened, the second end makes an electrical connection with the ground contact, and the third end is disconnected from the contact spring.

DETAILED DESCRIPTION

Figure 1:
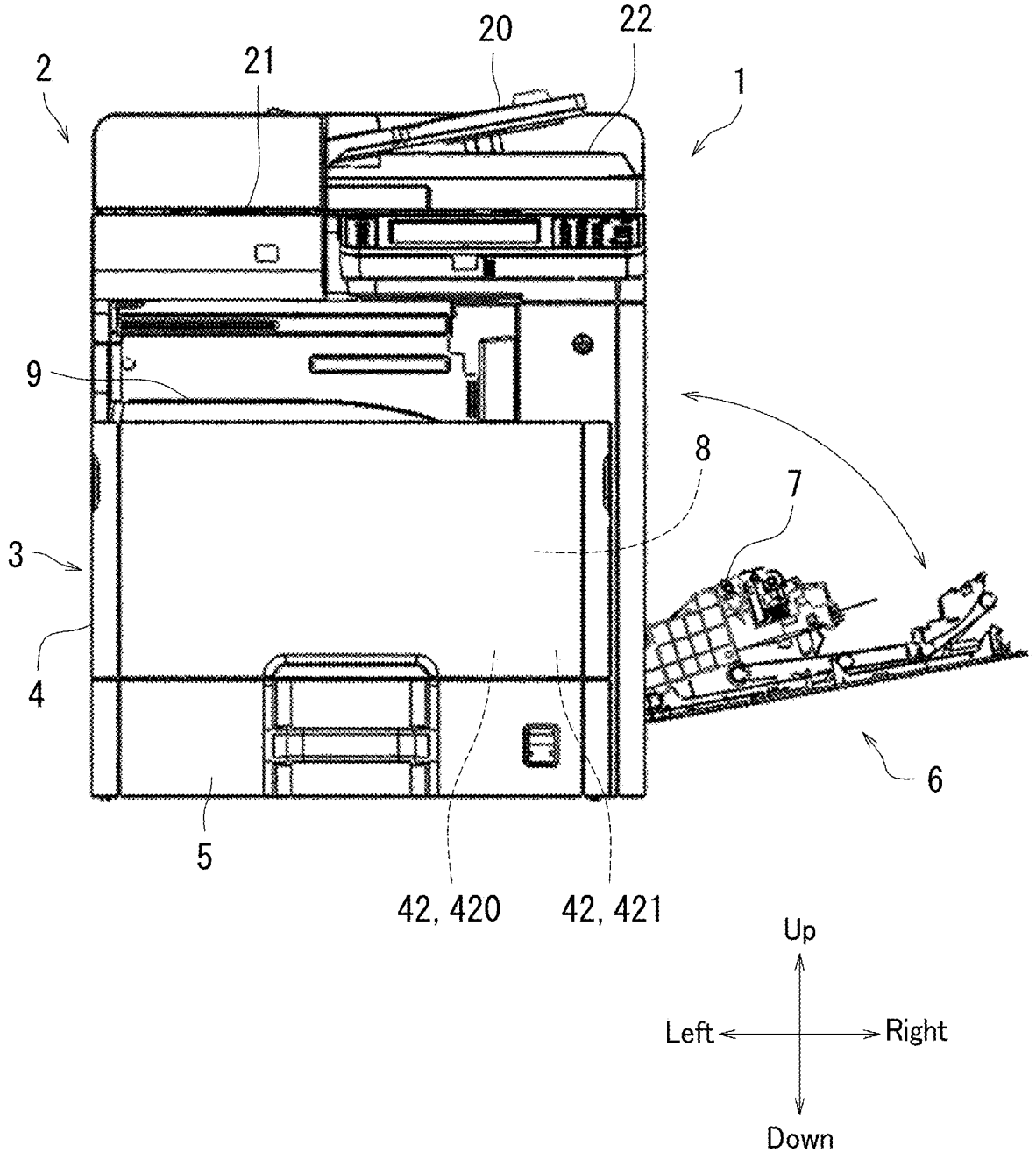
FIG. 1 is a diagram illustrating a multifunction peripheral including an image forming apparatus according to an embodiment of the present disclosure.

Hereinafter, an embodiment of the present disclosure will be described with reference to the accompanying drawings. Note that elements that are the same or equivalent are labeled the same reference signs in the drawings and description thereof is not repeated.

A multifunction peripheral 1 including an image forming apparatus 3 according to an embodiment of the present disclosure will be described with reference to FIG. 1. FIG. 1 is a diagram illustrating the multifunction peripheral 1 including the image forming apparatus 3 according to the present embodiment.

As illustrated in FIG. 1, the multifunction peripheral 1 includes an image reading device 2 and the image forming apparatus 3.

The multifunction peripheral 1 is a device that combines an image reading function provided by the image reading device 2 and an image forming function provided by the image forming apparatus 3. In an example, the multifunction peripheral 1 has functions such as a scanner, a printer, a copier, a telephone, a printing machine, and a facsimile.

The image reading device 2 includes a document tray 20, an image reading section 21, and a document exit tray 22.

The image reading device 2 reads an image on a document and outputs image information. An example of the image reading device 2 is a scanner. The image reading device 2 allows a document conveyor device to be attached to. An example of the document conveyor device is an auto document feeder (ADF).

The document tray 20 allows the document to be loaded on.

The image reading section 21 reads an image from the document conveyed from the document tray 20.

The image reading section 21 generates image data from the read image. The image reading section 21 may be provided with a contact image sensor (CIS) system and a charge-coupled device (CCD) system.

The document exit tray 22 allows the document from which the image has been read to be loaded on.

Next, the image forming apparatus 3 in FIG. 1 will be described. The image forming apparatus 3 forms an image on a sheet.

The image forming apparatus 3 includes a main body 4, a feeding unit 5, an open-close cover 6, a conveyance unit 7, a feed unit 8, an image forming section, a fixing section, and an ejection unit 9.

The main body 4, the conveyance unit 7, and the feed unit 8 will be described later with reference to FIG. 2 and later.

The feeding unit 5 includes a feeding tray and a pickup roller. The feeding tray stores sheets. The pickup roller picks up several sheets from the feeding tray and conveys the sheets one page at a time to the conveyance unit 7.

The open-close cover 6 is placed on a side surface of the main body 4. The open-close cover 6 is hinged on the main body 4 that allows the open-close cover 6 to move freely as it is opened and closed. The open-close cover 6 is provided with a handle that allows a user to operate. This enables the user to open and close the open-close cover 6 with respect to the main body 4 while holding the handle as illustrated by the double-headed arrow in FIG. 1.

When the open-close cover 6 is opened, the conveyance unit 7, the feed unit 8, the image forming section, the fixing section, and the like are exposed as an example. Opening the open-close cover 6 enables the user to carry out the maintenance of the conveyance unit 7, the feed unit 8, the image forming section, the fixing section, and the like.

The image forming section forms an image on a sheet with toner or ink. In the case where the image forming apparatus 3 is an electrophotographic system, the image forming apparatus 3 includes a photosensitive member, a charging device, a light exposure device, a development device, a transfer device, a cleaning device, and a static elimination device.

The photosensitive member is, for example a photosensitive drum. The photosensitive drum rotates about the axis of rotation. The photosensitive drum has a photosensitive layer on an outer peripheral surface thereof. An example of the photosensitive drum is an organic photoconductor (OPC).

The charging device charges the photosensitive layer of the photosensitive drum to a predetermined potential. The light exposure device allows a laser beam onto the photosensitive layer of the photosensitive drum, thereby exposing the photosensitive layer. The light exposure device exposes the photosensitive layer of the photosensitive drum based on image data. As a result, an electrostatic latent image is formed on the photosensitive drum. An example of the light exposure device includes an light emitting diode (LED).

The development device houses a dual component developer containing a carrier made of a magnetic material and toner, for example. The development device then develops the electrostatic latent image formed on the photosensitive drum with the toner to form a toner image on the photosensitive drum. The transfer device transfers the toner image on the photosensitive drum to a sheet. The cleaning device removes the residual toner remaining on the photosensitive drum after transfer. The static elimination device removes static electricity from the photosensitive drum.

In the case where the image forming apparatus 3 is an inkjet printer, the image forming section includes an ink tank, an ejection section, a conveyor belt, and a belt roller.

The ink tank stores water-based inks of each color such as, for example, Y yellow (Y), magenta (M), cyan (C), and black (Bk).

The ejection section is provided with a large number of recording heads and ink nozzles constituting pixels. Based on the image data, color inks corresponding to the image data are supplied from the ink tank to the recording heads in the ejection section. The inks are ejected from the recording heads toward the sheet.

The fixing device then heats and pressures the toner image developed on the sheet to fix the toner image on the sheet. The fixing device includes, for example, a heat roller, a press roller, and a heater.

The heat roller is a hollow cylindrical roller. The heat roller is pressed against the press roller. The press roller and the heat roller form a nip portion. The press roller is rotationally driven by a drive section (not illustrated) to rotate the heat roller by forming the nip portion with the heat roller.

The heater is powered by a power supply (not illustrated) to heat the heat roller. The heater is placed in close proximity to an inner peripheral surface of the heat roller. The sheet conveyed to the fixing device is heated by the heater by passing through the nip portion, so that the toner image is fixed thereon.

When the image forming apparatus 3 is an inkjet printer, the fixing device is not required.

The ejection unit 9 ejects the sheet outside the main body 4 of the image forming apparatus 3. The ejection unit 9 may include an ejection roller and an ejection tray. The ejection roller ejects, to the ejection tray, the sheet conveyed by the conveyance unit 7 from the fixing device. The ejected sheet is loaded on the ejection tray.

Figure 2A:
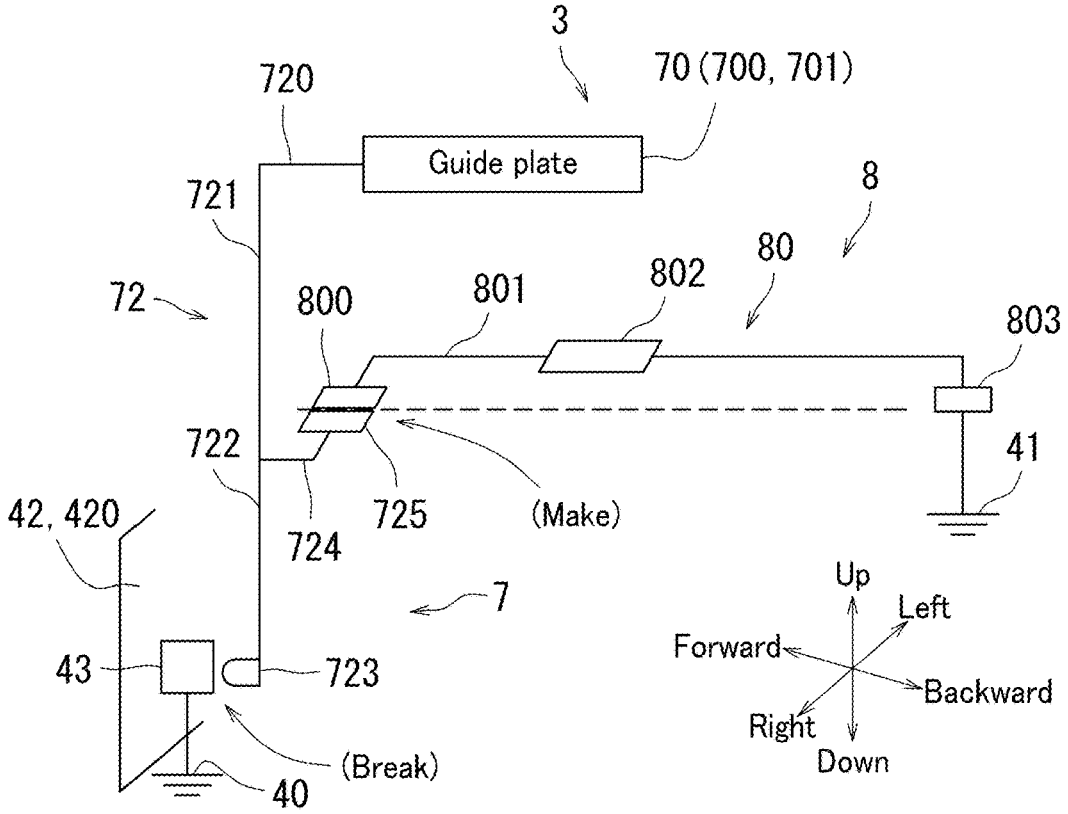
FIGS. 2A and 2B illustrate an outline of the image forming apparatus according to the present embodiment.
Figure 2B:
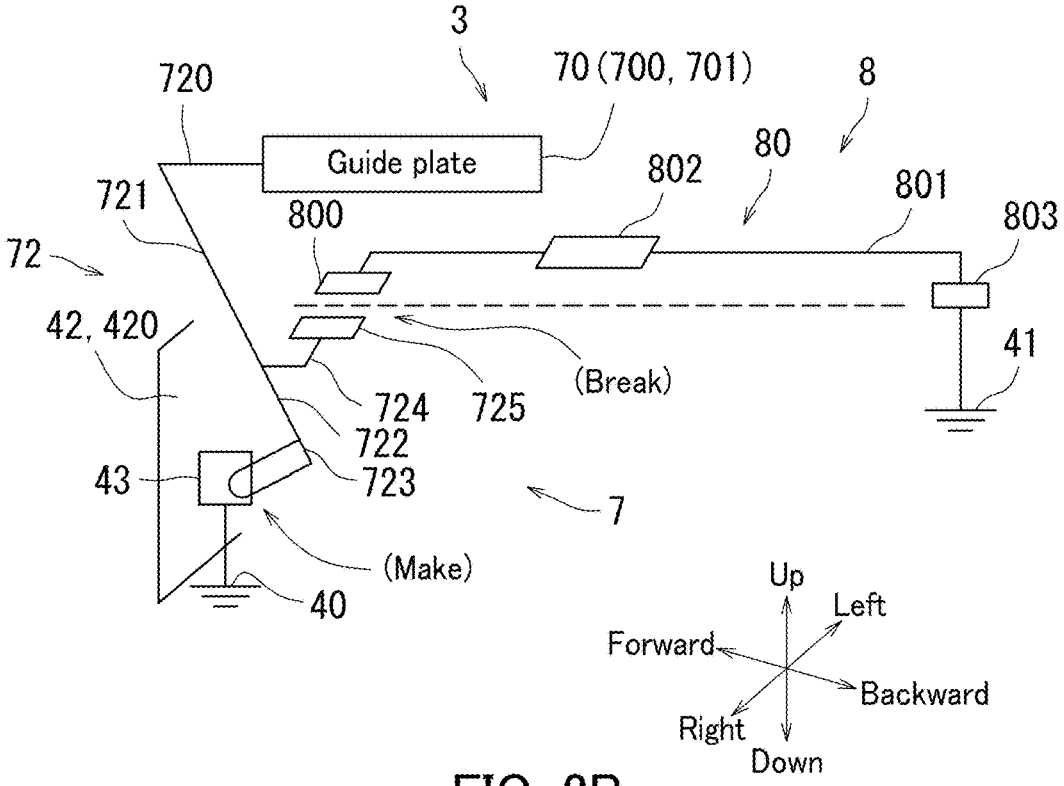
Figure 3:
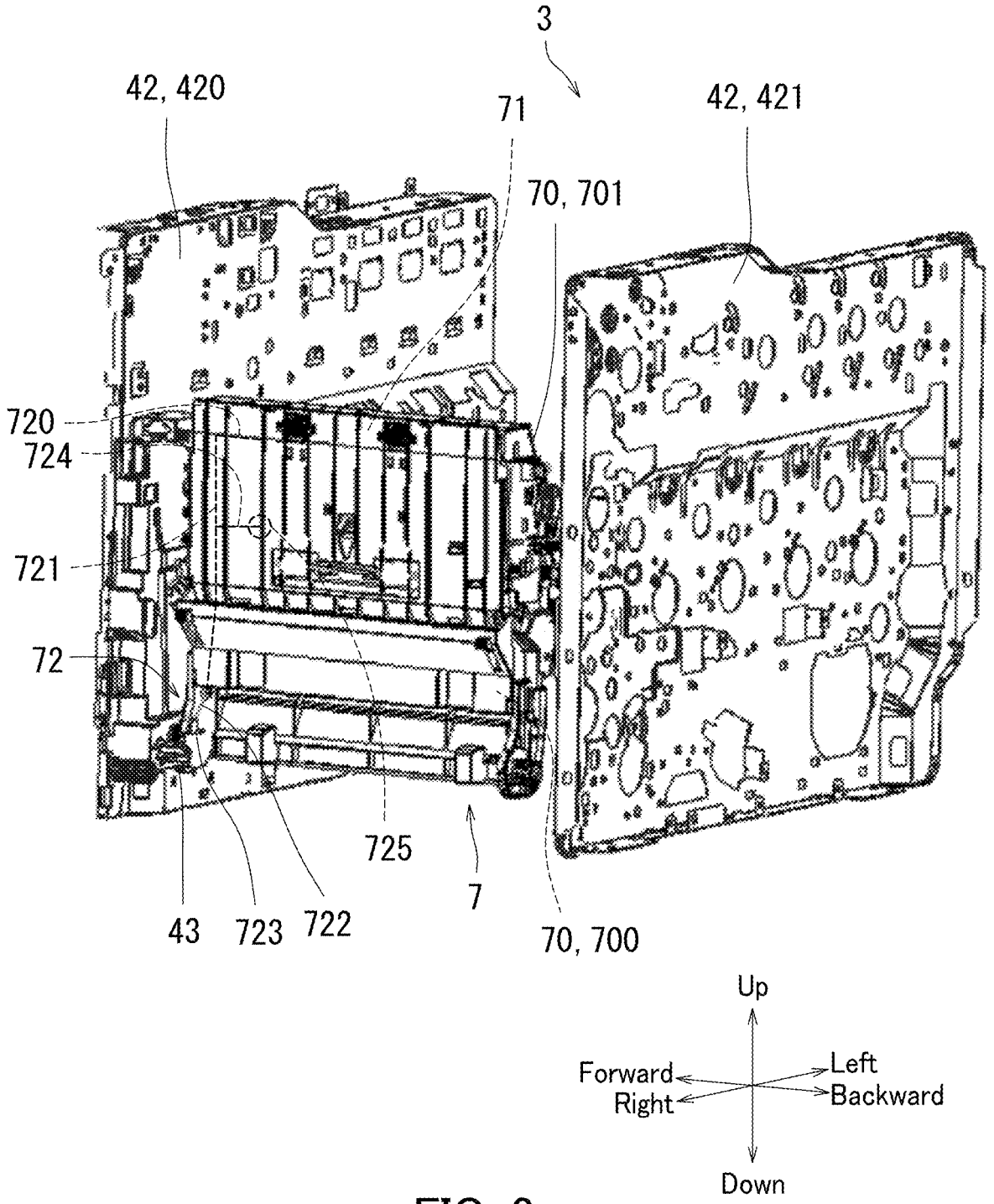
FIG. 3 is a diagram illustrating the configuration of a conveyance unit and chassis of the image forming apparatus according to the present embodiment.

Next, the image forming apparatus 3 according to the present embodiment will be described in detail with reference to FIGS. 2A to 9 in addition to FIG. 1. FIGS. 2A and 2B illustrate the outline of the image forming apparatus 3 according to the present embodiment. FIG. 3 is a diagram illustrating the configuration of the conveyance unit 7 and chassis 42 of the image forming apparatus 3 according to the present embodiment.

Figure 4:
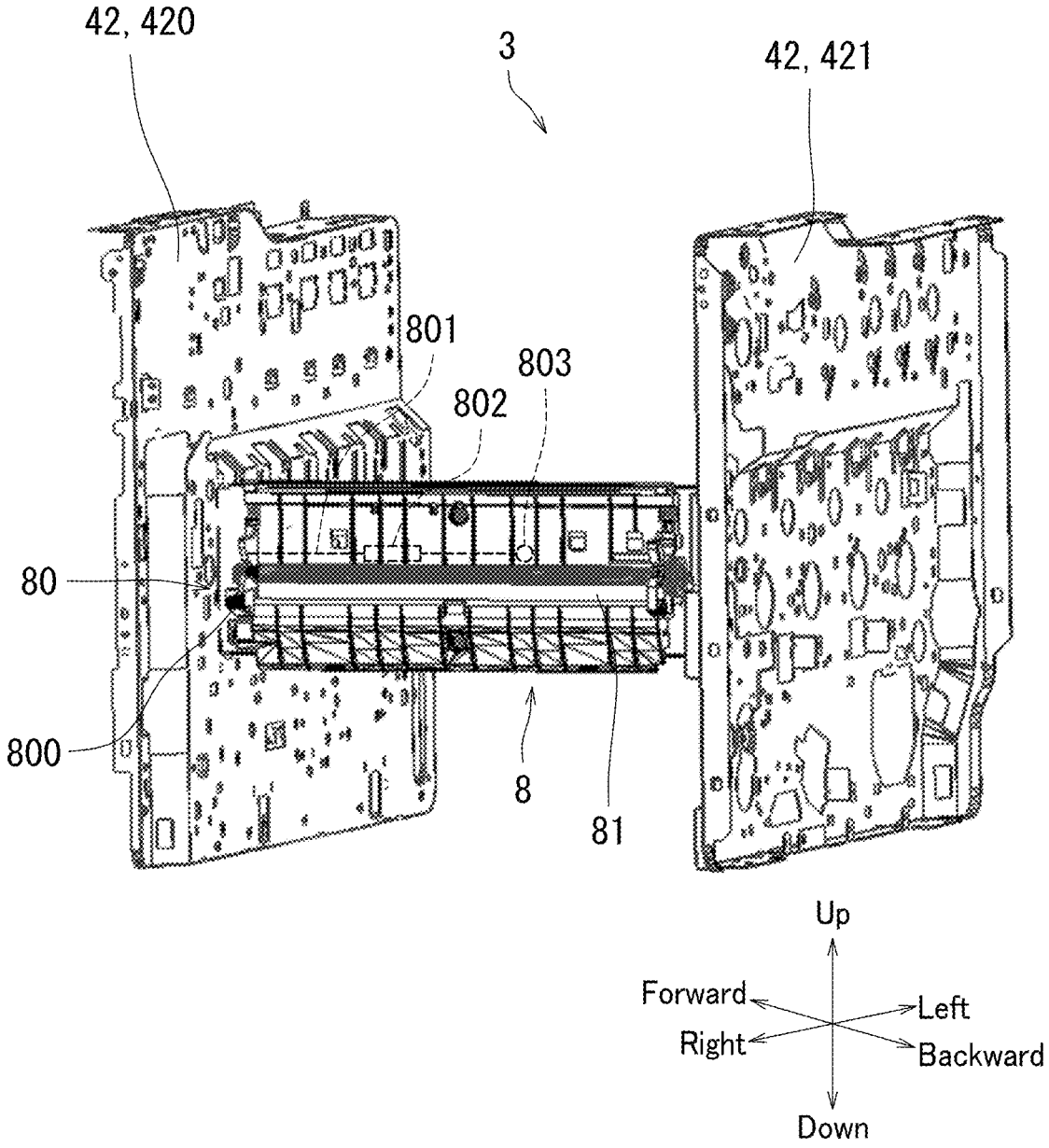
FIG. 4 is a diagram illustrating the configuration of a feed unit and the chassis of the image forming apparatus according to the present embodiment.
Figure 5:
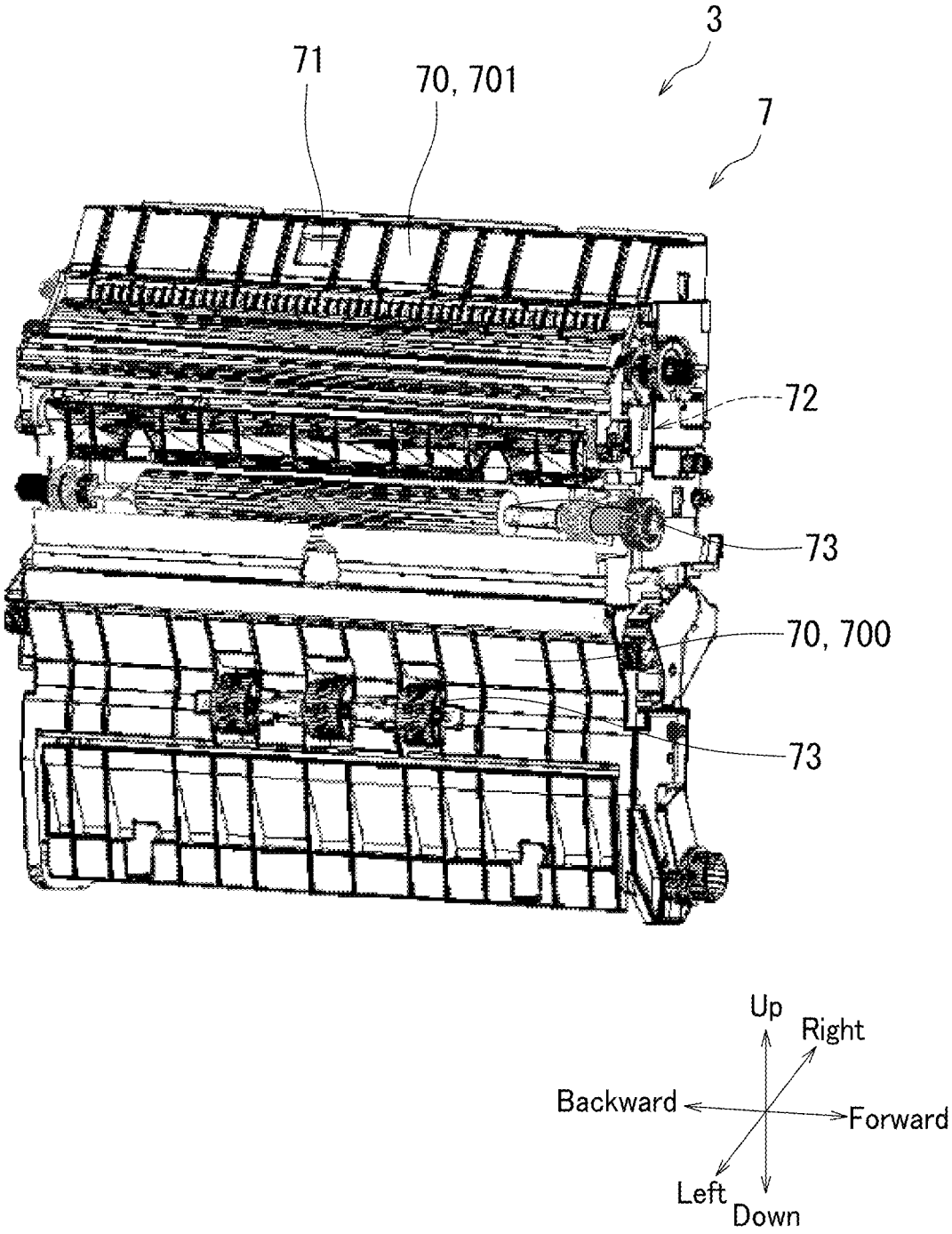
FIG. 5 is a diagram illustrating the configuration of the conveyance unit of the image forming apparatus according to the present embodiment.
Figure 6:
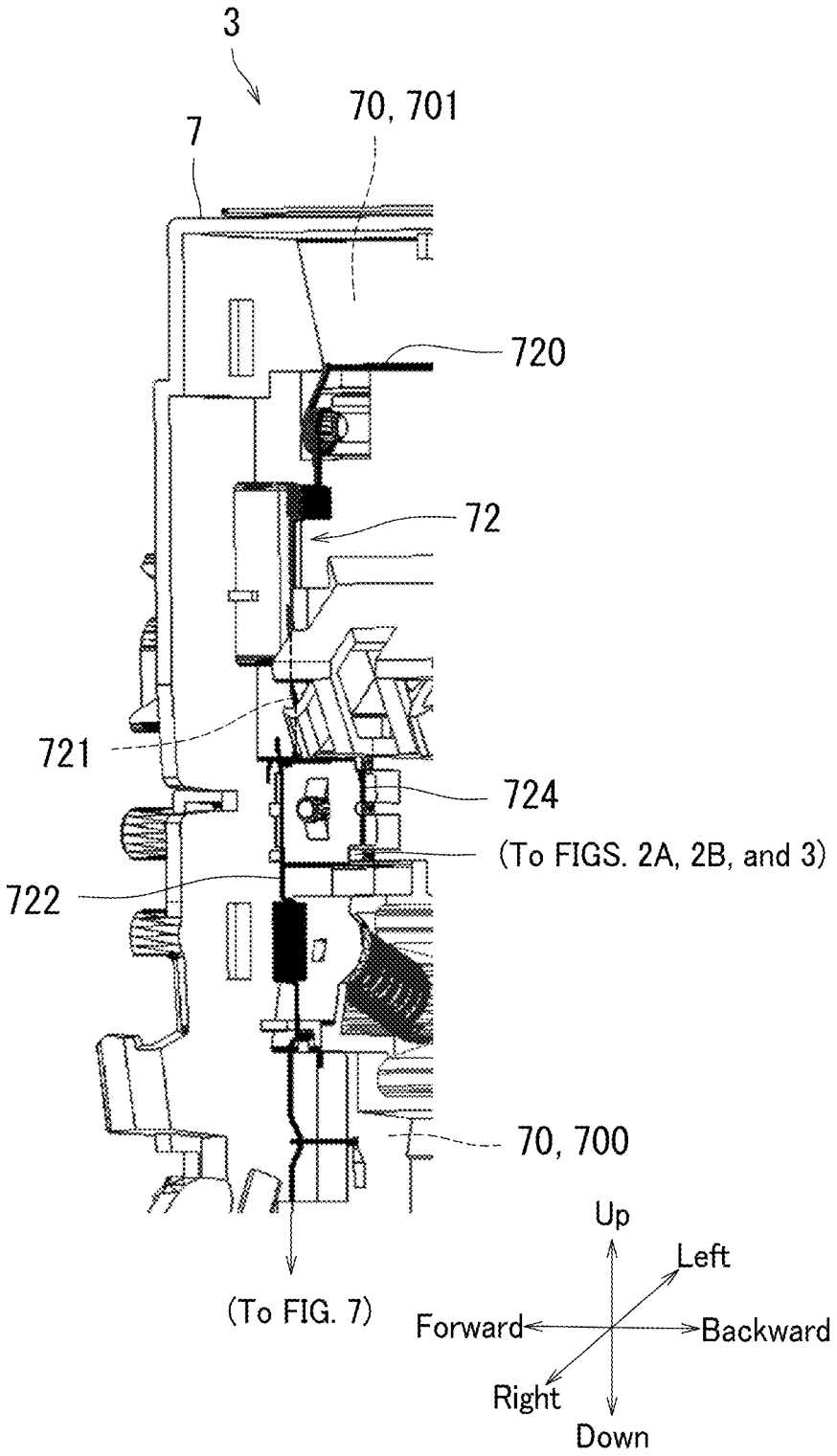
FIG. 6 illustrates the conveyance unit in FIG. 5 as viewed from the back side.
Figure 7:
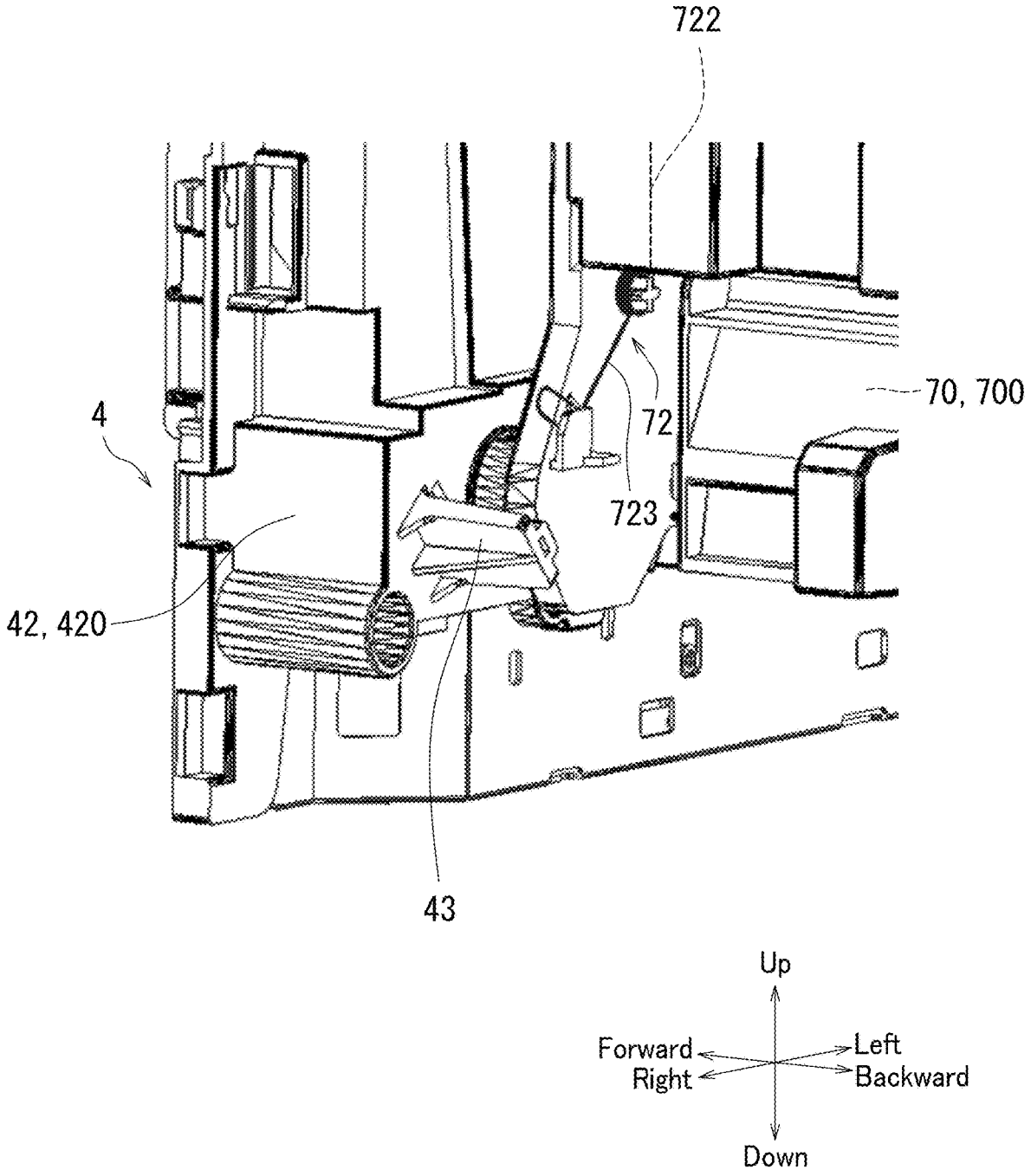
FIG. 7 is a diagram illustrating the lower structure of the conveyance unit in FIG. 6.
Figure 8:
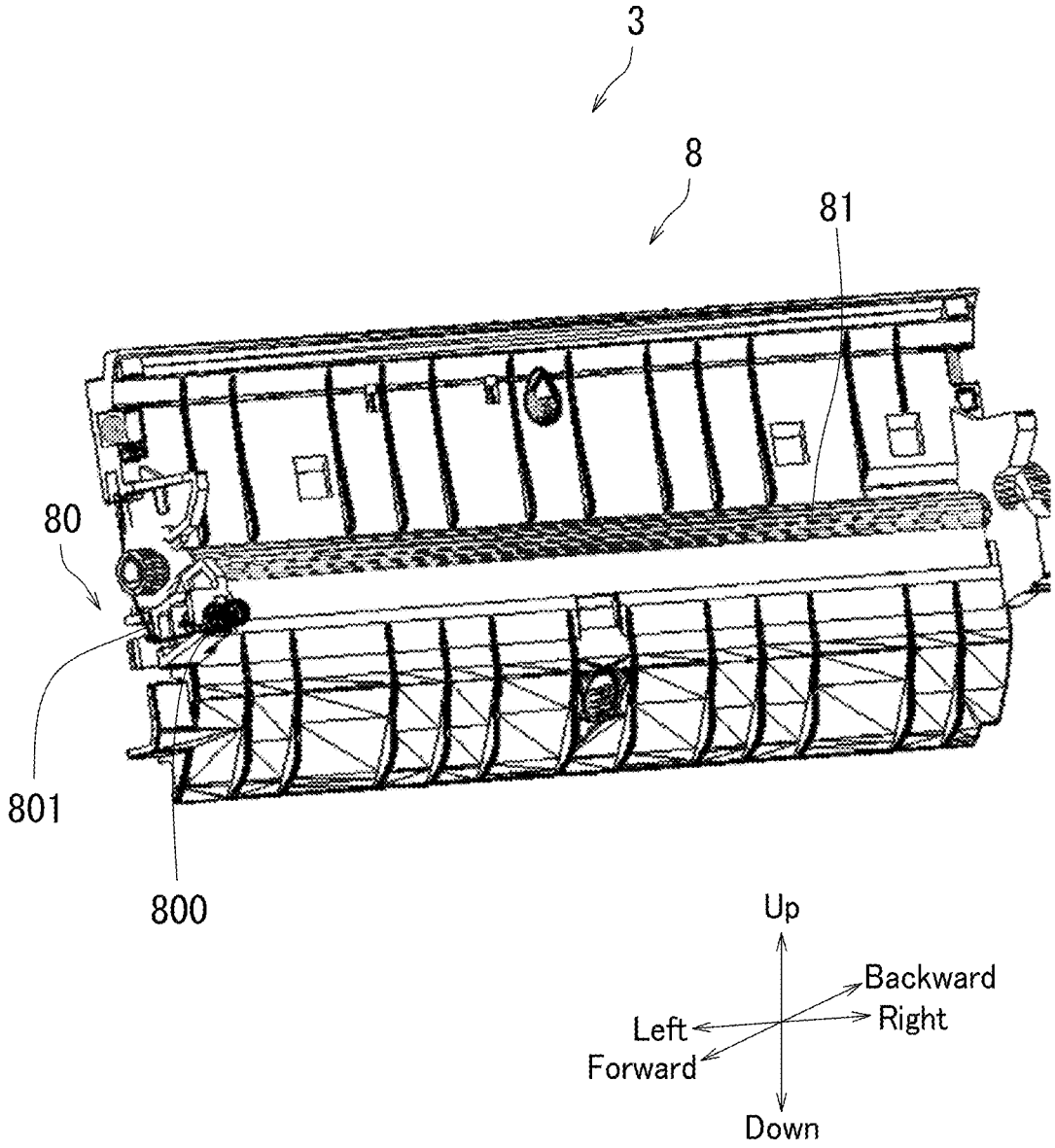
FIG. 8 is a diagram illustrating the configuration of the feed unit in FIG. 4.
Figure 9:
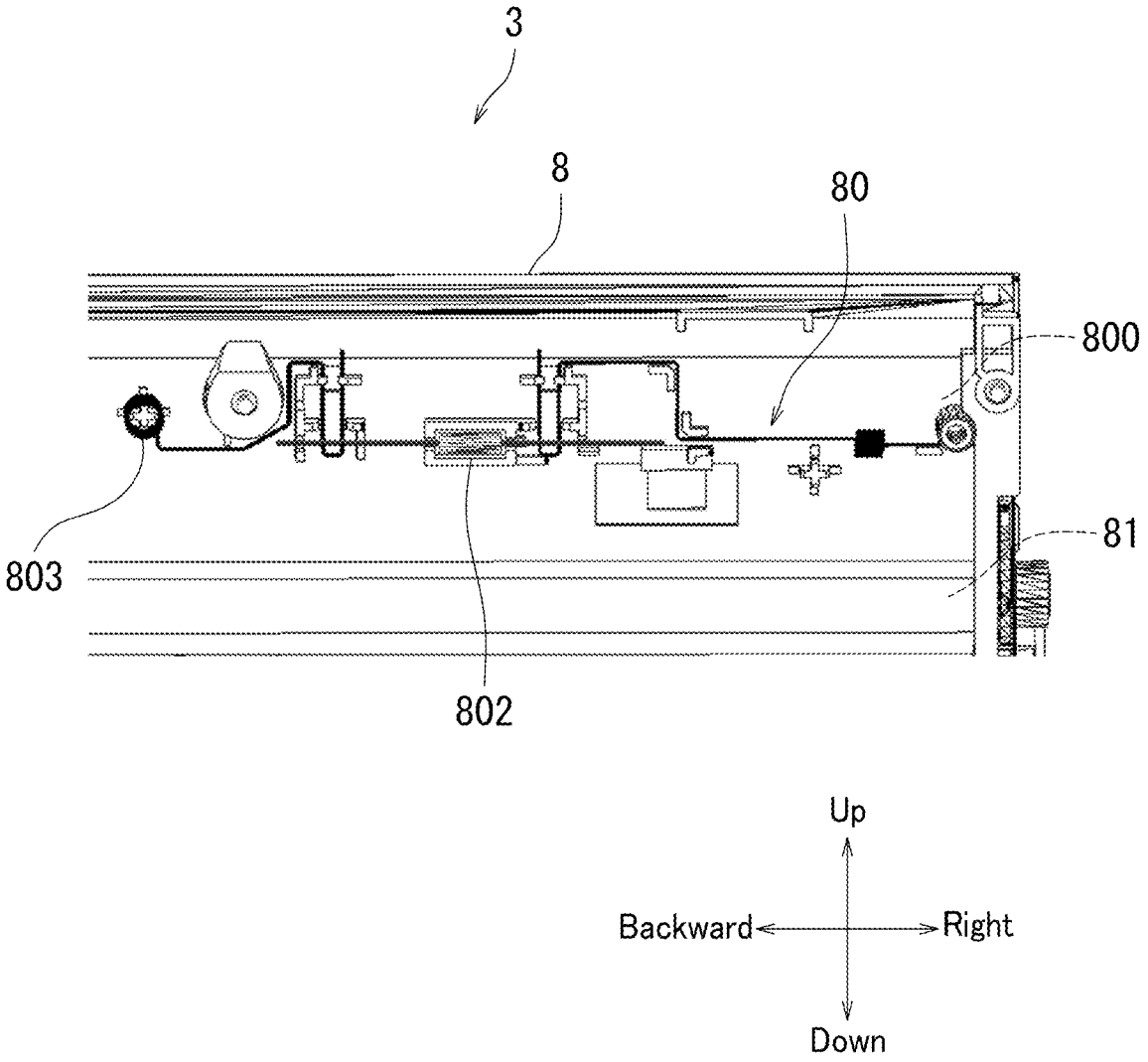
FIG. 9 illustrates the feed unit in FIG. 8 as viewed from the back side.

FIG. 4 is a diagram illustrating the configuration of the feed unit 8 and the chassis 42 of the image forming apparatus 3 according to the present embodiment. FIG. 5 is a diagram illustrating the configuration of the conveyance unit 7 of the image forming apparatus 3 according to the present embodiment. FIG. 6 illustrates the conveyance unit 7 in FIG. 5 as viewed from the back side. FIG. 7 illustrates the lower structure of the conveyance unit 7 in FIG. 6. FIG. 8 is a diagram illustrating the configuration of the feed unit 8 in FIG. 4. FIG. 9 illustrates the feed unit 8 in FIG. 8 as viewed from the back side.

The outline of the present disclosure will first be described with reference to FIGS. 2A and 2B. FIG. 2A illustrates an aspect in which the conveyance unit 7 is closed with respect to the main body 4. FIG. 2B illustrates an aspect in which the conveyance unit 7 is opened with respect to the main body 4.

As illustrated in FIG. 2A, the conveyance unit 7 is provided with a guide plate 70. The guide plate 70 guides the sheet to which a transfer voltage is applied, and therefore accumulates electric charges to be charged. The chassis 42 of the main body 4 to be described later in FIG. 3 are provided with a ground contact 43. A first wiring 72 (first main line 721) with no resistance element extends from the guide plate 70. A second end 723 is placed at the lower end of the first wiring 72 extending to the bottom of the main body 4, and faces the ground contact 43.

A first branch line 722 and a second branch line 724 branch from the first main line 721. The first branch line 722 extends to the second end 723. At the end of the second branch line 724, the third end 725 is exposed toward the feed unit 8.

In the feed unit 8, a contact spring 800 is exposed toward the conveyance unit 7. The contact spring 800 faces the third end 725 of the conveyance unit 7.

A second main line 801 extends from the contact spring 800 of the feed unit 8 to a ground spring 803 through a resistance element 802. The ground spring 803 is grounded by a grounding member placed in an appropriate position on the main body 4.

As illustrated in FIG. 2A, when the conveyance unit 7 is closed with respect to the main body 4 (in a closed position), the second end 723 is disconnected from the ground contact 43 (break). In addition, the third end 725 is in contact and makes an electrical connection with the contact spring 800 of the feed unit 8 (make).

An electric charge accumulated on the guide plate 70 is grounded from the ground spring 803 to a second ground 41 through the resistance element 802. Since the resistance element 802 is provided, the guide plate 70 is maintained at a suitable potential while the conveyance unit 7 is closed.

As illustrated in FIG. 2B, when the conveyance unit 7 is opened with respect to the body 4 (in an open position), the third end 725 is disconnected from the contact spring 800 of the feed unit 8 (break). In addition, the second end 723 is in contact and makes an electrical connection with the ground contact 43 (make).

The electric charge accumulated on the guide plate 70 is grounded from the ground contact 43 through the first wiring 72 with no resistance element. Therefore, the guide plate 70 is not charged while the conveyance unit 7 is opened. As a result, the user does not get an electric shock even if the user touches the guide plate 70. An overvoltage is not applied to an electronic device 71 placed on the guide plate 70, and the failure of the electronic device 71 can be prevented.

Noted that the above description with reference to FIGS. 2A and 2B is intended to facilitate understanding of the present disclosure. Therefore, the above description does not limit the scope of claims at all.

As illustrated in FIGS. 1 to 3, the main body 4 constitutes a housing of the image forming apparatus 3. The main body 4 includes a first ground 40 (FIGS. 2A and 2B), the second ground 41 (FIGS. 2A and 2B), the chassis 42 (FIG. 3), and the ground contact 43 (FIG. 3).

The first ground 40 grounds the guide plate 70 through the ground contact 43. The first ground 40 may ground the guide plate 70 from the ground contact 43 through the chassis 42.

The second ground 41 is placed in a suitable position of the image forming apparatus 3 and grounds the guide plate 70. The second ground 41 may ground the guide plate 70 through the chassis 42.

The chassis 42 reinforce the main body 4. The chassis 42 are grounded. The chassis 42 are, for example, conductive sheet metals such as aluminum sheet metals.

As illustrated in FIG. 3, the chassis 42 include a first chassis 420 and a second chassis 421. In an example of FIG. 3, the first chassis 420 is placed on the front side of the main body 4 in FIG. 1. The second chassis 421 is placed on the rear side of the main body 4.

The chassis 42 are provided with the ground contact 43. The ground contact 43 comes into contact with the second end 723 of the first wiring 72, thereby grounding an electric charge accumulated on the guide plate 70.

The ground contact 43 may ground the electric charge through the chassis 42. The ground contact 43 may be grounded as a result of the ground contact 43 itself being grounded.

As illustrated in FIG. 3, the first chassis 420 may be provided with the ground contact 43. Alternatively, the second chassis 421 may be provided with the ground contact 43.

The conveyance unit 7 conveys a sheet. The conveyance unit 7 is supported by the main body 4 with the conveyance unit 7 allowed to move freely as it is opened and closed.

As illustrated in FIG. 5, the conveyance unit 7 includes the guide plate 70, the electronic device 71, the first wiring 72, and conveyance rollers 73.

As illustrated in FIG. 3, both sides of the conveyance unit 7 are supported by the first chassis 420 and the second chassis 421.

The guide plate 70 guides a sheet in a conveyance direction. The guide plate 70 may include a pre-transfer guide plate 700 and a post-transfer guide plate 701.

The pre-transfer guide plate 700 is placed on the upstream side, in the conveyance direction of the sheet, of a transfer position where a toner image is transferred to the sheet The post-transfer guide plate 701 is placed on the downstream side, in the conveyance direction of the sheet, of the transfer position where the toner image is transferred to the sheet.

In an example, the electronic device 71 is placed inside a window formed in the post-transfer guide plate 701. Specific examples of the electronic device 71 include a camera, a light emitting section and a light receiving section, a magnetic sensor, and the like.

As illustrated in FIGS. 2A and 2B, the first wiring 72 is connected to the guide plate 70 and extends from the guide plate 70 to the ground contact 43. The first wiring 72 is a metal conducting wire for grounding static electricity on the guide plate 70.

As illustrated in FIGS. 3, 6, and 7, the first wiring 72 includes a first end 720 (FIG. 6), a first main line 721 (FIG. 6), the first branch line 722 (FIG. 6), the second end 723 (FIG. 7), the second branch line 724 (FIG. 6), and the third end 725 (FIG. 3).

As illustrated in FIG. 6, the first end 720 is connected to the guide plate 70. The first end 720 may be connected to the pre-transfer guide plate 700. The first end 720 may be connected to the post-transfer guide plate 701. The first end 720 may be formed in a spring shape. The guide plate 70 is grounded from the first end 720 through the first wiring 72.

The first end 720 may be connected to the electronic device 71. The electronic device 71 is grounded through the first wiring 72 from the first end 720.

As illustrated in FIG. 7, the second end 723 is allowed to move freely as it is connected to and disconnected from the ground contact 43.

As illustrated in FIG. 3, the first main line 721 extends from the first end 720.

The first branch line 722 branches off from the first main line 721 and extends to the second end 723.

The third end 725 is placed in a state of being exposed toward the feed unit 8.

The second branch line 724 branches off from the first main line 721 and extends to the third end 725.

As described above in FIG. 2B, when the conveyance unit 7 is opened, an electric charge accumulated on the guide plate 70 or the electronic device 71 is grounded to the first ground 40 from the first end 720 through the first main line 721, the first branch line 722, the second end 723, and the ground contact 43.

As illustrated in FIG. 4, the feed unit 8 is arranged to face the conveyance unit 7 (FIG. 3). When the conveyance unit 7 is closed, the feed unit 8 forms a conveyance path with the conveyance unit 7 to convey a sheet.

Both sides of the feed unit 8 are supported by the first chassis 420 and the second chassis 421.

As illustrated in FIGS. 8 and 9, the feed unit 8 includes a second wiring 80 and a feed roller 81.

When the conveyance unit 7 is closed, the feed roller 81 forms a nip portion with the conveyance rollers 73 of the conveyance unit 7 to convey a sheet. The feed roller 81 may be driven by a motor (not illustrated). The conveyance rollers 73 may be driven by a motor (not illustrated).

The second wiring 80 extends from the contact spring 800 and is grounded to the chassis 42. That is, as illustrated in FIG. 2A, the second wiring 80 is a metal conducting wire extending from the contact spring 800 provided in the feed unit 8 to the ground spring 803. The ground spring 803 makes an electrical connection with the second ground 41, so that the second wiring 80 is grounded.

As illustrated in FIGS. 8 and 9, the second wiring 80 includes the contact spring 800, the second main line 801, the resistance element 802, and the ground spring 803. The second wiring 80 illustrated in FIG. 8 extends from the contact spring 800 and is wired to the back side (opposite side from the conveyance unit 7) of the feed unit 8 as illustrated in FIG. 9.

As illustrated in FIGS. 2A and 2B, the contact spring 800 is allowed to move freely as it is connected to and disconnected from the third end 725 of the first wiring 72 in the conveyance unit 7.

As illustrated in FIG. 2A, when the conveyance unit 7 is closed, the second end 723 is disconnected from the ground contact 43 (break), and the third end 725 makes an electrical connection with the contact spring 800.

As illustrated in FIG. 2B, when the conveyance unit 7 is opened, the second end 723 makes an electrical connection with the ground contact 43, and the third end 725 is disconnected from the contact spring 800 (break).

The second main line 801 connects the contact spring 800, the resistance element 802, and the ground spring 803 as illustrated in FIGS. 2A, 2B, 8 and 9. The ground spring 803 is grounded to the chassis 42. Specifically, the ground spring 803 is grounded to the second ground 41.

As described above in FIG. 2A, when the conveyance unit 7 is closed, the third end 725 of the conveyance unit 7 makes an electrical connection with the contact spring 800 of the feed unit 8.

Therefore, an electric charge accumulated on the guide plate 70 or the electronic device 71 is grounded to the second ground 41 from the first end 720 through the first main line 721, the second branch line 724, the third end 725, the contact spring 800, the second main line 801, the resistance element 802, and the ground spring 803.

In the present embodiment, when the conveyance unit 7 is closed, an electric charge on the guide plate 70 is grounded through the second wiring 80 including the resistance element 802. Therefore, the guide plate 70 can be held at a predetermined potential. When the conveyance unit 7 is opened, an electric charge on the guide plate 70 is grounded through the first wiring 72 (with no resistance element). Therefore, the guide plate 70 can be set to the ground potential, and the user's electric shock can be suppressed.

In the present embodiment, when the conveyance unit 7 is opened, an electric charge on the guide plate 70 is grounded through the first wiring 72 (with no resistance element). Therefore, the guide plate 70 can be set to the ground potential, and damage to the electronic device 71 can be suppressed.

In the present embodiment, the conveyance unit 7 includes the pre-transfer guide plate 700. Even in this case, when the conveyance unit 7 is opened, an electric charge on the pre-transfer guide plate 700 is grounded through the first wiring 72 (with no resistance element). Therefore, the pre-transfer guide plate 700 can be suitably grounded.

In the present embodiment, the conveyance unit 7 includes the post-transfer guide plate 701. Even in this case, when the conveyance unit 7 is opened, an electric charge on the post-transfer guide plate 701 is grounded through the first wiring 72 (with no resistance element). Therefore, the post-transfer guide plate 701 can be suitably grounded.

An embodiment of the present disclosure is described above with reference to the accompanying drawings. However, the present disclosure is not limited to the above embodiment and may be implemented in various manners within a scope not departing from the gist thereof. The drawings mainly illustrate various constituent elements schematically to facilitate understanding. Aspects such as length and number of the constituent elements illustrated in the drawings may differ in practice for convenience of drawing preparation. Furthermore, aspects such as material, shape, and dimension of the constituent elements illustrated in the above embodiment are only examples and not particular limitations. The constituent elements may be variously altered within a scope not substantially departing from the configuration of the present disclosure.

What is claimed is:

1. An image forming apparatus, comprising:

a main body;

a conveyance unit that conveys a sheet, the conveyance unit being supported by the main body with the conveyance unit allowed to move freely as the conveyance unit is opened and closed; and a feed unit placed to face the conveyance unit, the feed unit forming a conveyance path with the conveyance unit to convey the sheet when the conveyance unit is closed, wherein the main body includes a chassis that is grounded, and a ground contact provided for the chassis, the conveyance unit includes a guide plate that guides the sheet in a conveyance direction, and a first wiring that is connected to the guide plate and extends from the guide plate to the ground contact, the first wiring including a first end connected to the guide plate, a second end that is allowed to move freely as the second end is connected to and disconnected from the ground contact, a third end exposed toward the feed unit, a first main line extending from the first end, a first branch line that branches off from the first main line and extends to the second end, and a second branch line that branches off from the first main line and extends to the third end, the feed unit includes a second wiring, the second wiring including a contact spring that is allowed to move freely as the contact spring is connected to and disconnected from the third end, a resistance element, a ground spring this is grounded to the chassis, and a second main line that connects the contact spring, the resistance element, and the ground spring, wherein when the conveyance unit is closed, the second end is disconnected from the ground contact, and the third end makes an electrical connection with the contact spring, and when the conveyance unit is opened, the second end makes an electrical connection with the ground contact, and the third end is disconnected from the contact spring.

2. The image forming apparatus according to claim 1, wherein the conveyance unit further includes an electronic device, and the first end is also connected to the electronic device.

3. The image forming apparatus according to claim 1, wherein the guide plate is a pre-transfer guide plate placed on an upstream side, in the conveyance direction of the sheet, of a transfer position where a toner image is transferred to the sheet.

4. The image forming apparatus according to claim 1, wherein the guide plate is a post-transfer guide plate placed on a downstream side, in the conveyance direction of the sheet, of a transfer position where a toner image is transferred to the sheet.

* * * * *